US006025576A

United States Patent [19]

Beck et al.

[11] Patent Number: 6,025,576

[45] Date of Patent: Feb. 15, 2000

[54] BULK VESSEL HEATER SKID FOR LIQUEFIED COMPRESSED GASES

[76] Inventors: Anthony J. Beck, 318 Market St., Sante Cruz, Calif. 95061; John C Daderko, 328 E. Patterson St., Lansford, Pa. 18232; Lawrence P Jarrett, 1368 Jacobsburg Rd., Wind Gap, Pa. 18091; Bruce H Greenawald, 4702 Terrace Rd., Orefield, Pa. 18069; Aric K Plumley, 10 Morea Ave., La Selva Beach, Calif. 95076

[21] Appl. No.: 09/034,876

[22] Filed: Mar. 4, 1998

[51] Int. Cl.[7] ..... H05B 3/06; F27D 11/00; F17B 1/00; A47F 5/08; F24H 1/18

[52] U.S. Cl. ..... 219/521; 219/385; 219/432; 219/436; 219/429; 48/174; 211/111

[58] Field of Search ..... 219/521, 524, 219/432, 436, 429, 385; 48/174; 206/0.6, 0.7; 220/4.12, 4.16; 211/71.01, 69.6, 68.8, 107, 111, 119.06; 392/458, 459

[56] References Cited

U.S. PATENT DOCUMENTS

| | | | |
|---|---|---|---|
| 1,443,500 | 1/1923 | Phillips | 52/192 |
| 1,548,219 | 8/1925 | Soderquist et al. | 109/34 |
| 2,596,244 | 5/1952 | Jacket | 220/15 |
| 2,804,029 | 8/1957 | Fitzgerald | 109/34 |
| 3,199,710 | 8/1965 | Hovey | 220/1 |
| 4,023,681 | 5/1977 | Plant | 211/74 |
| 4,030,487 | 6/1977 | McEachran | 128/24.1 |
| 4,606,521 | 8/1986 | Williams | 248/214 |
| 5,025,936 | 6/1991 | Lamoureaux | 211/74 |
| 5,167,142 | 12/1992 | Sharp | 73/49.2 |
| 5,197,595 | 3/1993 | Coultas | 206/0.6 |
| 5,239,713 | 8/1993 | Toivio et al. | 5/81.1 |
| 5,555,999 | 9/1996 | Wilcox | 220/565 |

*Primary Examiner*—John A. Jeffery
*Assistant Examiner*—Daniel L. Robinson
*Attorney, Agent, or Firm*—Charles J. Kulas, Townsend and Townsend and Crew, LLP

[57] ABSTRACT

A skid with built-in heating elements for heating and supporting a compressed-gas dispensing bulk vessel, or cylinder, while allowing for manipulation and transportation of the cylinder and skid assembly. The skid incorporates all of the features necessary for handling a cylinder while also providing a means for heating the cylinder in a controlled manner. The heater skid comprises a framework for receiving the cylinder and one or more heaters coupled to the framework so that the received cylinder is proximate to the heaters, thus, allowing the heaters to heat the cylinder. A control system for the heaters is also disclosed.

13 Claims, 13 Drawing Sheets

| FIG. 5A. | FIG. 5B. |
|---|---|

| FIG. 6A. | FIG. 6B. |
|---|---|

BULK VESSEL HEATER SKID FOR LIQUEFIED COMPRESSED GASES

BACKGROUND OF THE INVENTION

This invention deals in general with heating a container that stores and dispenses compressed gas and, specifically, with a heater arrangement attached to a skid for heating bulk vessels that store and dispense liquefied compressed gas.

A problem exists where compressed gases are dispensed from cylinders. As the high pressure gases are emitted from the cylinder the expansion of the gases absorbs thermal energy which causes a cooling at the point of dispensation that propagates throughout the cylinder to cause an undesirable cooling of the cylinder walls and of the gases within the cylinder. Cooling at the valve or regulator can cause frosting that creates other problems with gas flow in the overall system. Where the gases are compressed and liquefied within the cylinder, the evaporation of liquid to gas also causes cooling of the liquid, gas and cylinder. This causes the cylinder pressure (vapor pressure) to drop. The effect of the cooling is to reduce the maximum steady state flowrate that can be obtained from the cylinder. Extremely low temperatures can be created which can cause "embrittlement" of the cylinder that can result in a rupture and explosion of the highly pressurized cylinder.

The trend in industry is to require higher gas flow rates from larger cylinders which increases the cooling problems. By using larger cylinders of liquefied compressed gases the supporting and maintenance of numerous small cylinders is eliminated and space is conserved. These larger cylinders are called "bulk vessels" or "tonnage containers." A popular type of bulk vessel is, for example, the "Y" cylinder manufactured by Air Products and Chemicals MLRM of Allentown, Pa. The "Y" cylinder is 24" in diameter by approximately 7' long and weighs about 1150 lbs., empty. Chemicals such as HCl and ammonia are commonly dispensed in bulk gas delivery systems using the "Y" cylinder. Where the current demand is for gas flows in the range of 100–500 standard liters per minute (slpm) it is difficult to provide a rate higher than about 25 slpm for some gases because of the adverse effects from cooling in bulk gas delivery systems using the "Y" cylinder.

Various measures exist in the prior art for trying to maintain the temperature of a dispensing cylinder. One approach is to cover the cylinder in a thermal insulation material which helps to sustain the temperature of the cylinder. However, merely using insulation does not keep the cylinder at sufficiently high temperatures and may actually prevent ambient heat from heating the cylinder. More effective is the use of heaters applied to the cylinder. However, the cylinders are handled and stored by placement or attachment to skeletal frameworks, or "skids." This makes it cumbersome to attach heaters to the cylinder. The heaters must be attached when the cylinders are taken from a transport skid and placed onto a storage skid. The heaters must later be removed when the cylinder is exhausted and needs to be sent back for re-filling.

Typically, a cylinder is not well-suited for handling, transportation, storage, etc. This is because the cylindrical shape is unwieldy and the elongated cylinder is easily tipped or rolled and is unstable in a standing or laying position. Further, the cylinder's shape does not lend itself well to being lifted. For these reasons, a rectangular framework, or "skid," is used which receives a pressurized cylinder into a skeletal structure that is designed for easier transporting, storing and support. Typically, such a skid will include slots for fork-lift access, tie-down fasteners to secure the cylinder and end stops for positioning the cylinder. The skid also provides a degree of protection to the cylinder. An example of a prior-art skid plus cylinder assembly is shown in FIG. 7A. The skid shown in FIG. 7A is not suitable for the application of heaters because there is no clearance between the cylinder and transport. Another prior art cylinder is shown in FIG. 7B. The skid of FIG. 7B has adequate clearance to allow strap-on heaters as shown. Temperature sensors are mounted to straps sense the temperature about mid-way up the cylinder.

A transport skid is "loaded" with a cylinder at the gas-producing manufacturer's site. The transport skid plus cylinder assembly is then shipped to a purchaser, such as an end user. The end user places the cylinder plus skid assembly at the point of dispensation of the gas. Appropriate hookups are made for controlled dispensing.

In order to alleviate the cooling effect resulting from the dispensing of gas, a current approach is to place heaters around the cylinder. However, such a procedure is time consuming and cumbersome. This is because many of the transport skids provide little room to secure the heaters. In some cases, the cylinder might have to be released from the skid to properly attach the heaters.

Thus, it is desirable to have a more efficient method for providing heating to cylinders such as "Y" cylinders that store liquefied compressed gases.

SUMMARY OF THE INVENTION

The present invention provides a skid with built-in heating elements. The skid incorporates all of the features necessary for handling a cylinder while also providing a means for heating the cylinder in a controlled manner. A control system for the heaters is also disclosed.

In one embodiment a heater skid for heating and handling a cylinder that stores and dispenses compressed gas is disclosed. The heater skid comprises a framework for receiving the cylinder and one or more heaters coupled to the framework so that the received cylinder is proximate to the heaters, thus, allowing the heaters to heat the cylinder.

DESCRIPTION OF THE PREFERRED EMBODIMENT

Figure 1:
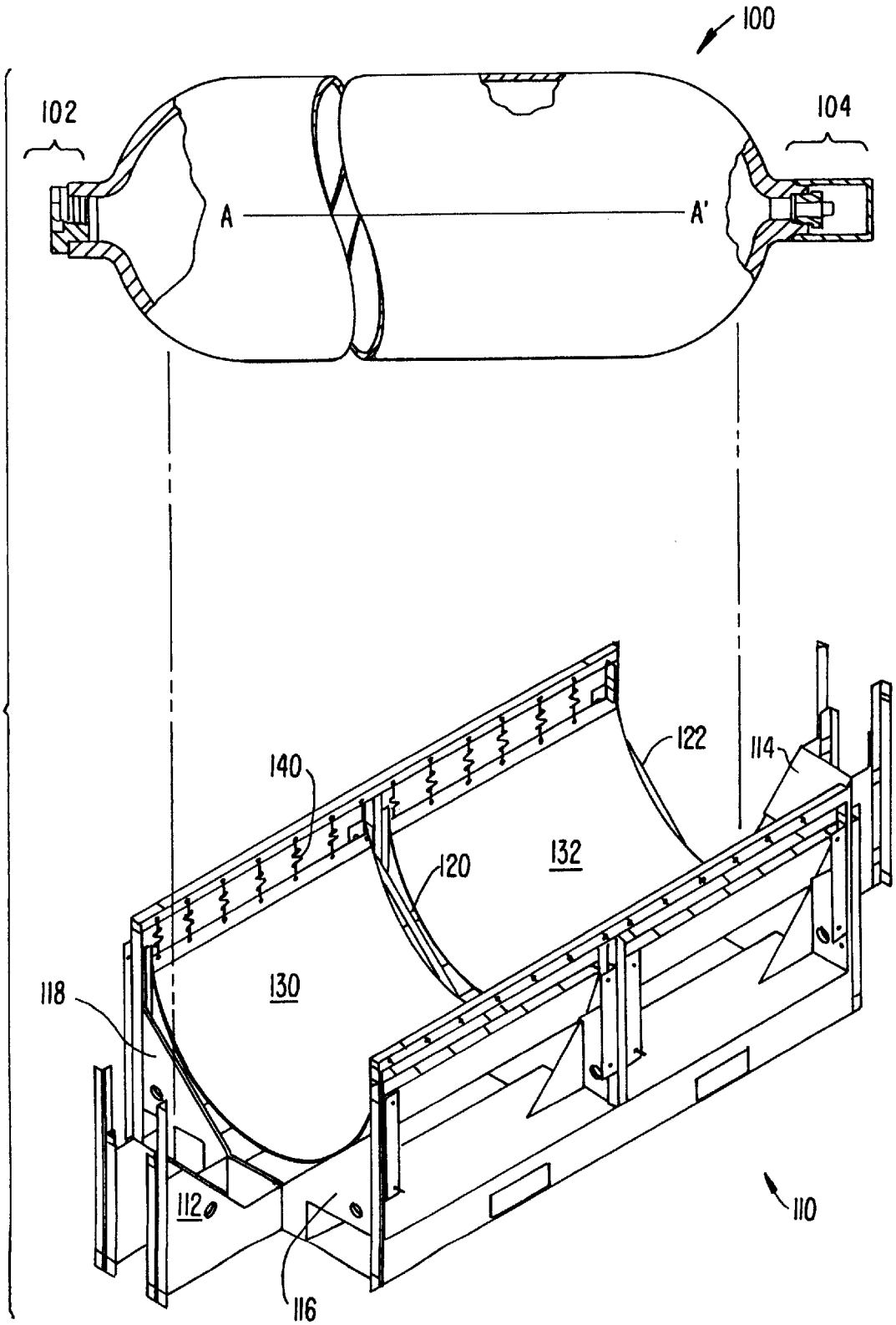
FIG. 1 shows a Y-cylinder and the heater skid of the present invention.

FIG. 1 shows a Y-cylinder 100 in cutaway view. Line A–A' is the longitudinal axis of the cylinder. Although the invention is discussed with respect to a specific cylinder, namely, a "Y" cylinder it should be apparent that the invention is adaptable for a container of any arbitrary shape.

Y-cylinder 100 includes top end 102 which includes a valve assembly for dispensing the compressed gas and a bottom end 104 which houses a safety cluster for emitting the compressed gas inside the cylinder should the gas exceed a predetermined pressure.

FIG. 1 also shows heater skid assembly 110. The dashed lines between cylinder 100 and heater skid 110 show the approximate position of the cylinder when it is received by a skid. It is of interest to note the points of contact of the cylinder with the heater skid shown in FIG. 1. In the preferred embodiment there will be six points of contact between a typical Y-cylinder and the heater skid's support ribs. The six support ribs are positioned in symmetrical pairs at opposite sides of the longitudinal axis A–A'. In FIG. 1, four of the six support ribs can be seen as support ribs 116, 118, 120 and 122. The ribs which are not shown are those symmetrically opposing support ribs 120 and 122. The support ribs are planar pieces of metal approximately one-half inch thick. Because the support ribs have straight edges at about a 45 degree angle to the direction of gravity in the orientation as shown, the cylinder will contact each rib at only one point. This ensures that the thermal transfer from the cylinder to the framework (which could act as a heat sink) is minimized. In the preferred embodiment, each support rib is ½" thick and is provided with a rubber pad at the point of contact with cylinder 100. Naturally, other material, or no material at all, may be used. The rubber provides extra thermal insulation between cylinder 100 and skid 110. Because the support ribs are inclined toward the received cylinder, they assist in centering the cylinder for proper placement within the skid.

An additional point of contact can occur near either the top or bottom ends of the cylinder which may contact end stops 112 or 114. Points of the side of the cylinder near the top or bottom ends can contact a plate at each of the end stops inclined at a 45° angle with respect to the longitudinal axis of the cylinder. In actual use, the cylinder will only contact one or the other of the top or bottom plates because the plates are separated by a distance slightly greater than the gross length of cylinder 100.

Once cylinder 100 is placed onto skid 110, heaters 130 and 132 are in full contact with cylinder 100. Springs such as spring 140 serve to keep heaters 130 and 132 in tensioned contact with the cylinder. Note that heaters 130 and 132 are positioned (without a received cylinder) slightly above the support ribs. When a cylinder is received by skid 110, the weight of the cylinder presses downward on heaters 130 and 132 which causes the received cylinder to sink until the walls of the cylinder contact the supporting ribs. This design ensures that heaters 130 and 132 will be placed in sufficient thermal contact with cylinder 100 while support for the cylinder comes from the support ribs, not the heaters.

Figure 2A:
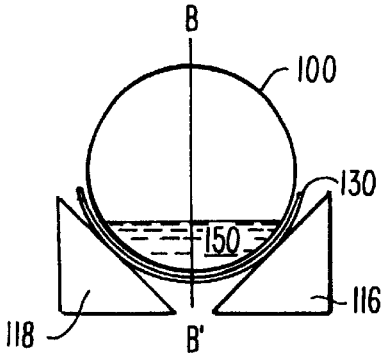
FIG. 2A is a cross-sectional diagram of the cylinder, liquefied gas, heaters and support ribs.

FIG. 2A shows a cross-sectional view of cylinder 100 and support ribs 116 and 118. In general, identically numbered parts in different Figures denote the same item. Liquid 150 within cylinder 100 is shown pooled at the bottom of the cylinder by gravity as the cylinder rests in the skid. Heater 130 is shown proximate to cylinder 100 and wrapping almost halfway around cylinder 100. That is, the lower half of the cylinder is substantially covered by heater 130 (and heater 132 which is not shown but which is directly behind heater 130 in FIG. 2A). For illustrative purposes, FIG. 2A shows heater 130 as not quite contacting cylinder 100. In actual practice the heater would be contacting the cylinder. The preferred embodiment uses heaters formed of flexible flat sheets of silicone rubber with wire-wound heating elements embedded within the sheets.

The liquefied gas 150 in FIG. 2A is shown at a low level as it would be near the end of exhaustion of the compressed gas from the cylinder. When the cylinder is full, the liquefied gas sumps to contact the cylinder walls extending above the heater coverage (not shown). Gas is dispensed until the liquid level has dropped so that the liquefied gas occupies only about 10% volume of the cylinder. This brings the contact area of the liquefied gas to below the contacted heater area as shown in FIG. 2A (shown, but not to scale). The heaters are of sufficient dimension to heat about 17.5" on either side of the B–B' center line so that a large amount of cylinder wall not contacting the liquid is not heated when the gas is near depeletion. This provides efficient heat transfer to the liquified gas in the full range of full-to-empty use. The heaters are each about 24" long so that approximately 48" along the length of the cylinder is heated.

Although the preferred embodiment is directed to compressed liquefied gas, the invention can also apply to non-liquefied compressed gas containers. In this case, the concern of heater dimension to match the liquid level would not be a concern. In fact, the heaters can be placed arbitrarily about the cylinder as, for example, on the top of the cylinder, at the sides, at the ends or along the bottom as discussed. Some compressed chemicals also result in the chemical obtaining a solid state. In this case, the thermal considerations of the chemical in going from a solid to a liquid, and then from a liquid to a gas are similar to those described here for a liquified gas chemical. A similar heating approach to that disclosed here can be employed to apply heat to the area of the container where most of the solidified or liquified chemical is situated.

Figure 2B:
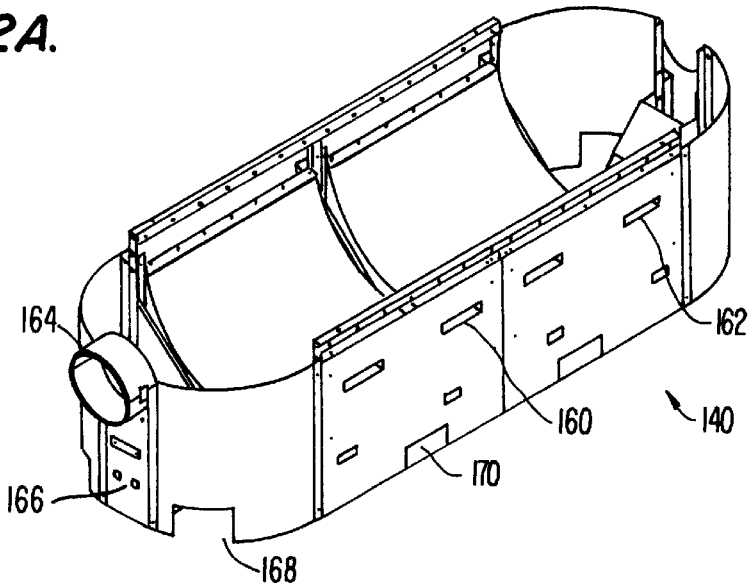
FIG. 2B is a diagram of the skid with side panels attached.

FIG. 2B shows panels 140 secured to skid 110 of FIG. 1. The preferred embodiment uses painted stainless steel panels for durability as the skid assembly may be exposed to weather conditions. Panels 140 form part of a structure that completely encloses a cylinder as discussed below. In FIG. 2B, the panels include handles such as 160 and 162. FIG. 2B also shows clam shell exhaust lip 164 which acts to protect the protruding valve of a received cylinder (not shown). Conduit exit holes at 166 are also shown which provide a path for the sensor monitoring signals discussed below. Also, fork-lift access slots are present at 168 and 170 and other places around the panels.

Figure 2C:
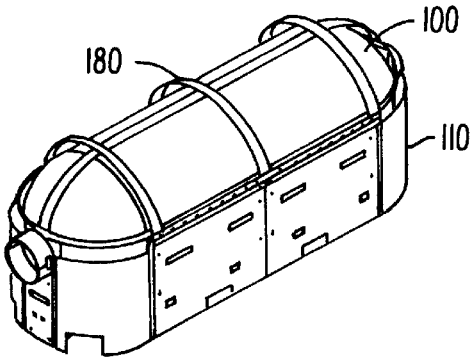
FIG. 2C is a diagram of the skid with side panels and top framework.

FIG. 2C shows a cylinder 100 resting in skid 110 and surrounded by panels 140. Additional structure in the form of standoff 180 is shown attached to the skid and panels. Standoff 180 provides a small amount of space between the standoff structure and the cylinder.

Figure 2D:
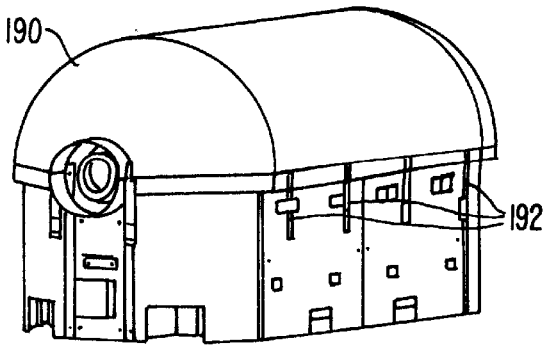
FIG. 2D is a diagram ofthe skid with a thermal blanket applied.

FIG. 2D shows insulation blanket 190 secured by tie-down straps such as 192. The blanket is weather proof Teflon impregnated fiberglass cloth. The standoff design ensures that there is enough air next to the cylinder within the enclosure formed of the blanket, panels and skid to allow convective heat transfer to minimize thermal loss to the external environment. The light weight of the blanket and readily accessed tie-down points allow the blanket to be quickly removed or affixed to the skid assembly.

Figure 3:
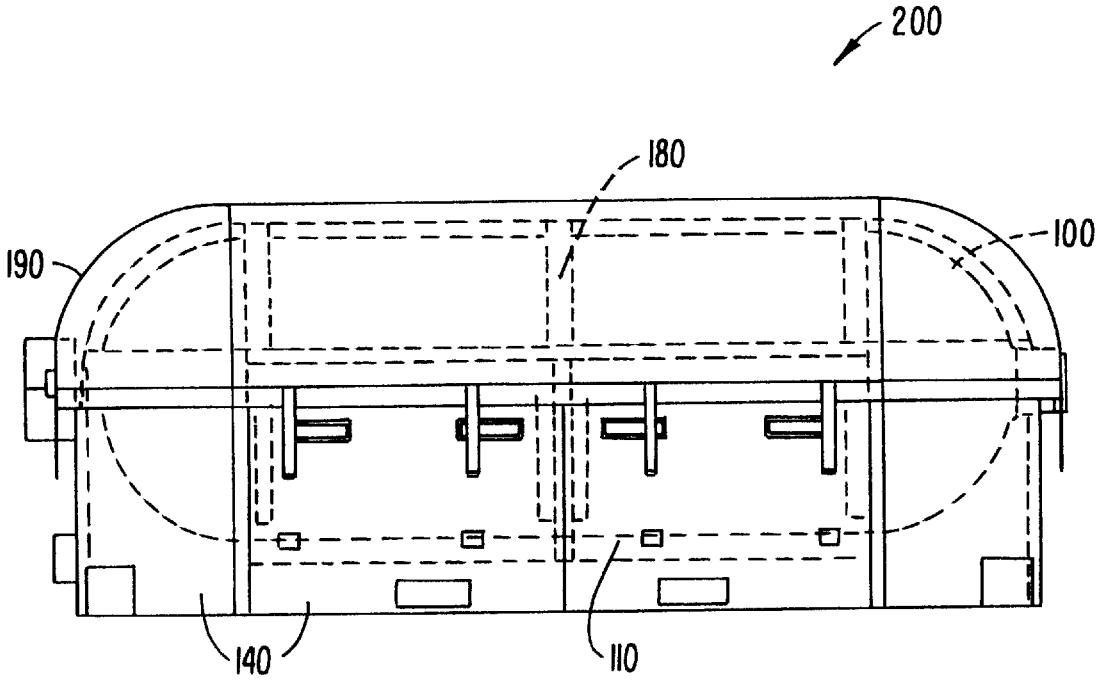
FIG. 3 is a mechanical drawing of the cylinder plus skid assembly.

FIG. 3 is a mechanical side-view of the complete skid assembly including cylinder 100, skid 110, panels such as 140, standoff 180 and thermal blanket 190. The weight of the skid assembly without the cylinder is about 330 lbs. The skid is approximately 85.8" long, 27.12" wide and 33.0" high. The assembly provides a fully-enclosed housing for a cylinder both protecting the cylinder and allowing more accurate control over the cylinder's temperature. Thus, the "Y" cylinder heater is designed to encase the cylinder in a true-to-form fit to the cylinder walls of the heating elements. The cylinder is adequately supported, insulated and has an exterior weather-proof cover. The cylinder necks, which include the cylinder valve on one end and the safety cluster on the other remain outside the heater enclosure. Exhaust connections are incorporated on both ends of the heater enclosure (not shown) to capture any emissions from the cylinder valve or the safety cluster. The entire heater and skid assembly can be lifted on any side by means of forklift or overhead crane.

The heating elements are located in the bottom of the heating chamber along the sides of the cylinder where liquid would pool when the cylinder is placed into the skid. This provides heat to the liquid region of the cylinder where it is most effective in maintaining the vapor pressure inside the cylinder.

Figure 4:
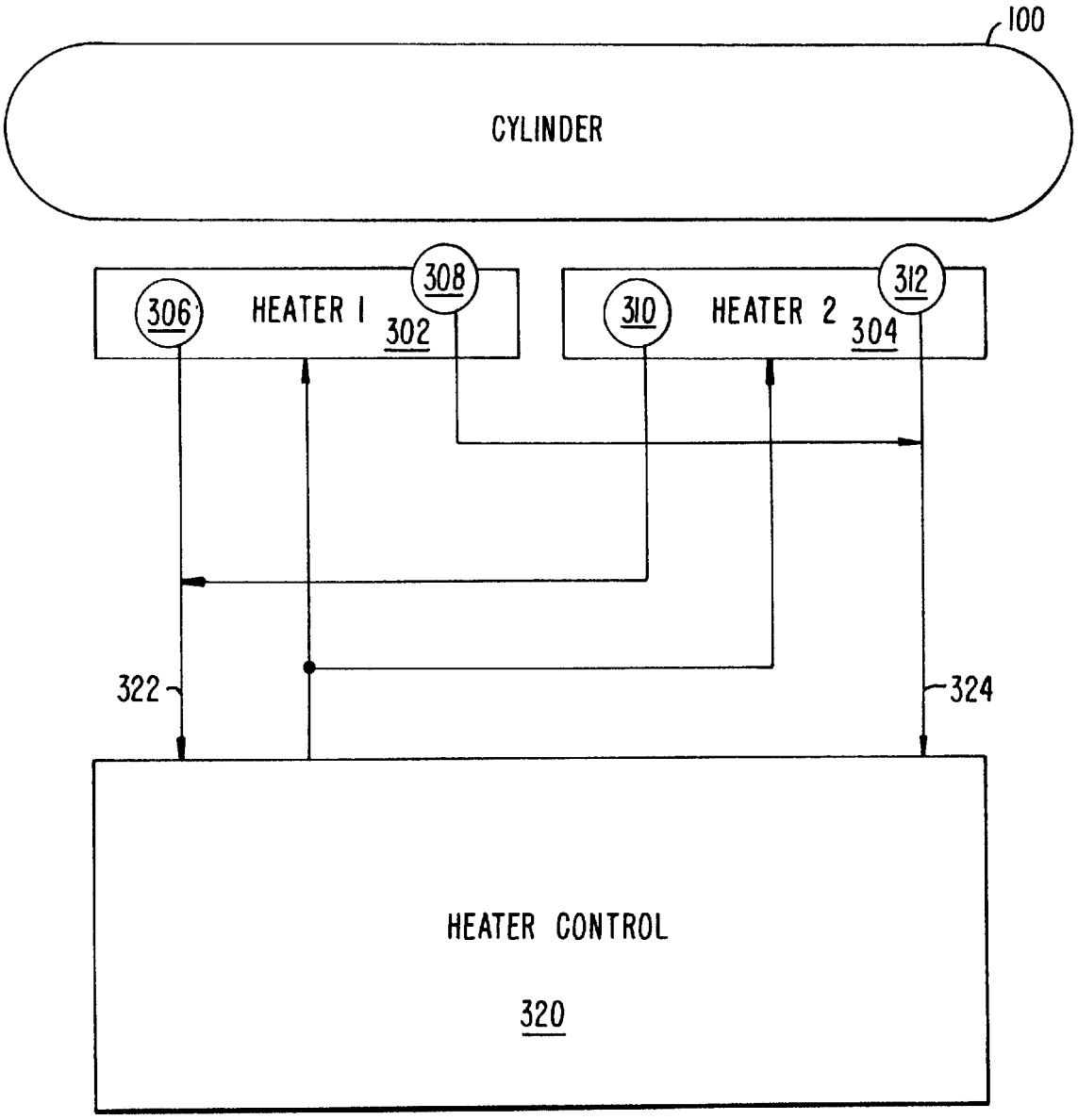
FIG. 4 is a block diagram of the heater control system.

FIG. 4 shows a schematic illustration of the heater control system and sensors.

In FIG. 4, cylinder 100 is heated by heaters 302 and 304. Each heater includes two temperature sensors incorporated within the heater, itself. Heater1 has a heater temperature sensor 306 and a part temperature sensor 308. Likewise, Heater2 has a heater temperature sensor 310 and a part temperature sensor 312. The part temperature sensors are used to sense the temperature of the cylinder. Although the part temperature sensors are embedded into the heaters, each part temperature sensor is surrounded by a 1-inch diameter "dead zone" that is devoid of heating elements. This allows the part temperature sensors to be responsive to the temperature of the cylinder rather than the temperature of the heater, itself. The heater temperature sensor information is conveyed by electrical signals to heater control 320 along connection 322. The part temperature sensor information is conveyed along connection 324. Other temperature sensor arrangments are possible. Heater control 320 allows an operator to set limits on both the heater maximum temperature and the cylinder (or "part") maximum temperature. In the preferred embodiment the heater maximum temperature is set to less than 125 degrees Fahrenheit.

The part temperature sensor information is used to control the power to the heaters transmitted along connection 326 to regulate the amount of heat provided to the cylinder. This is done in accordance with a desired cylinder temperature, also set by an operator, and the sensed cylinder temperature provided by part temperature sensors 308 and 312. Note that although the sensor and heater control signals for each heater are shown combined, the system can also work where the heaters are treated as separate subsystems without sharing signals.

Figures 5, 5A:
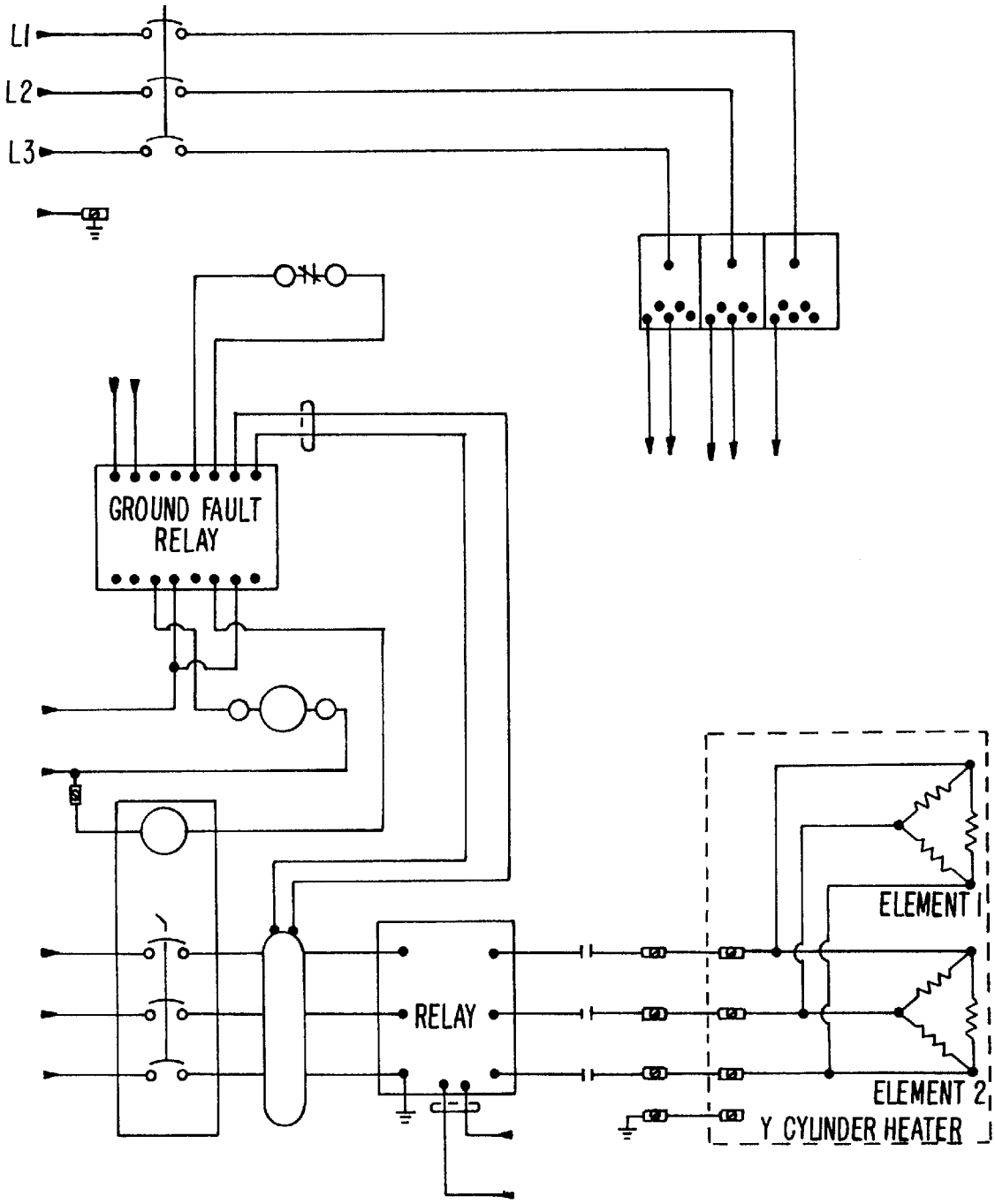
FIG. 5 is a first schematic diagram of the heater control system.
Figure 5B:
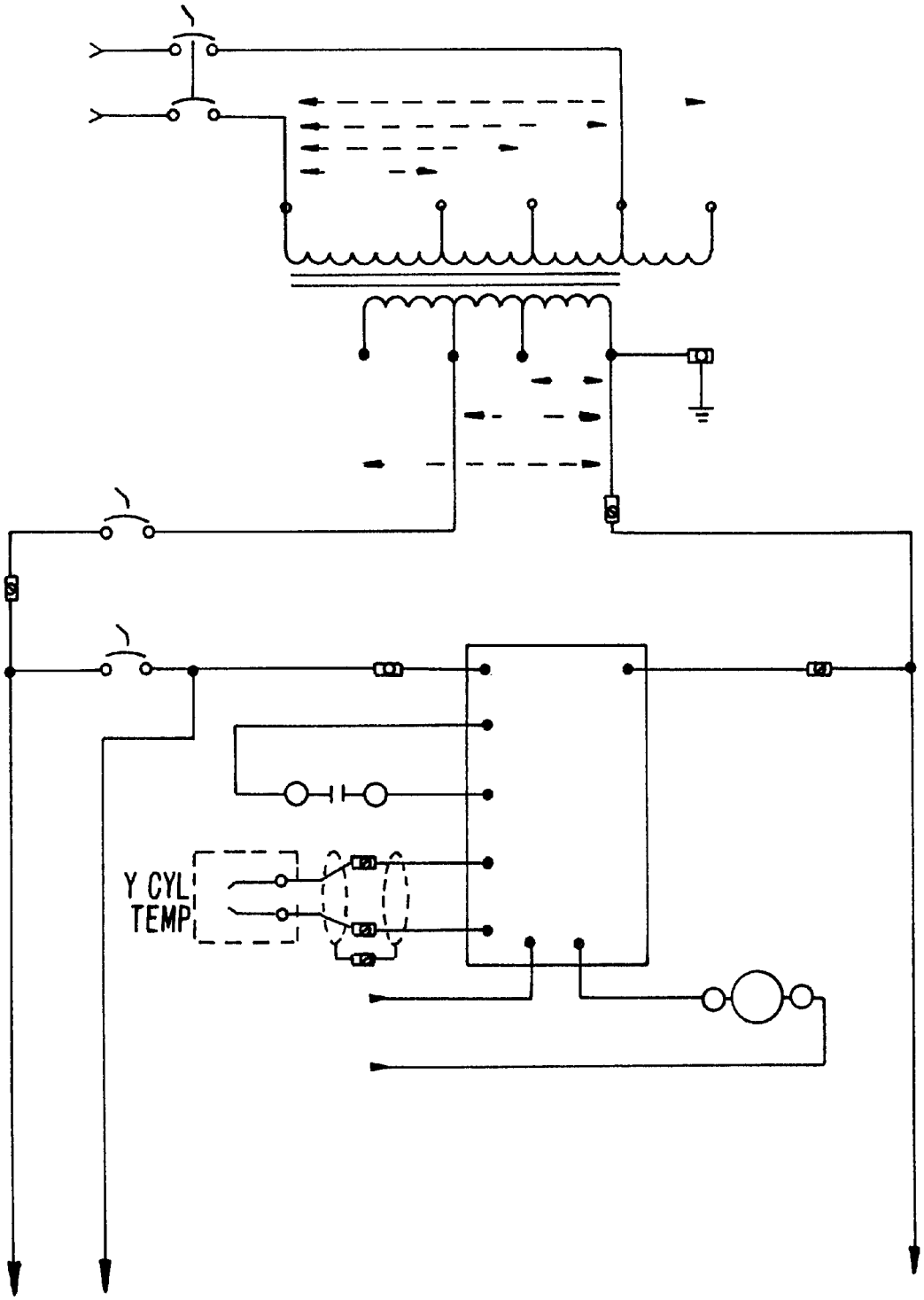
Figure 6A:
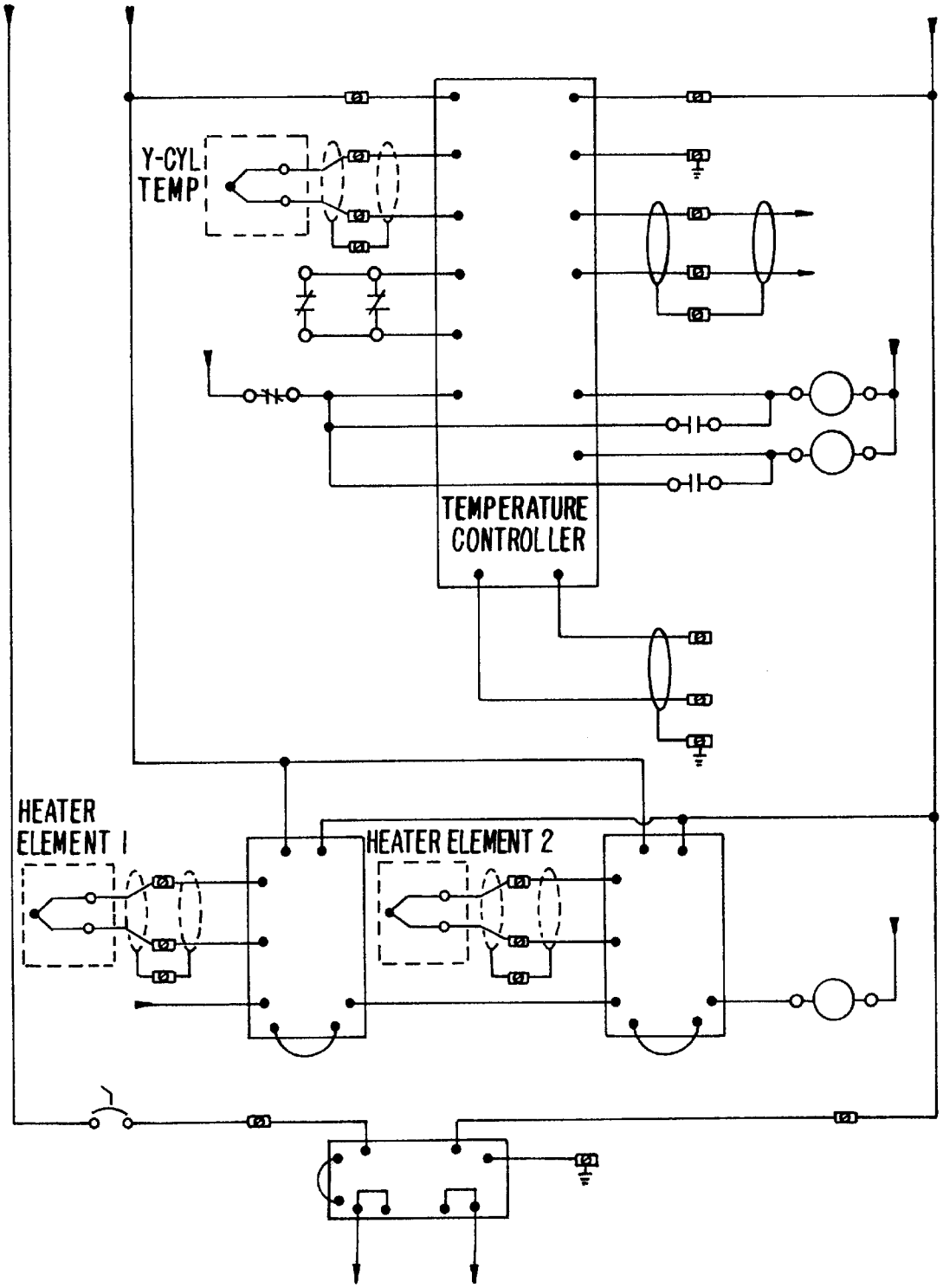
FIG. 6 is a second schematic diagrm of the heater control system.
Figures 6, 6B:
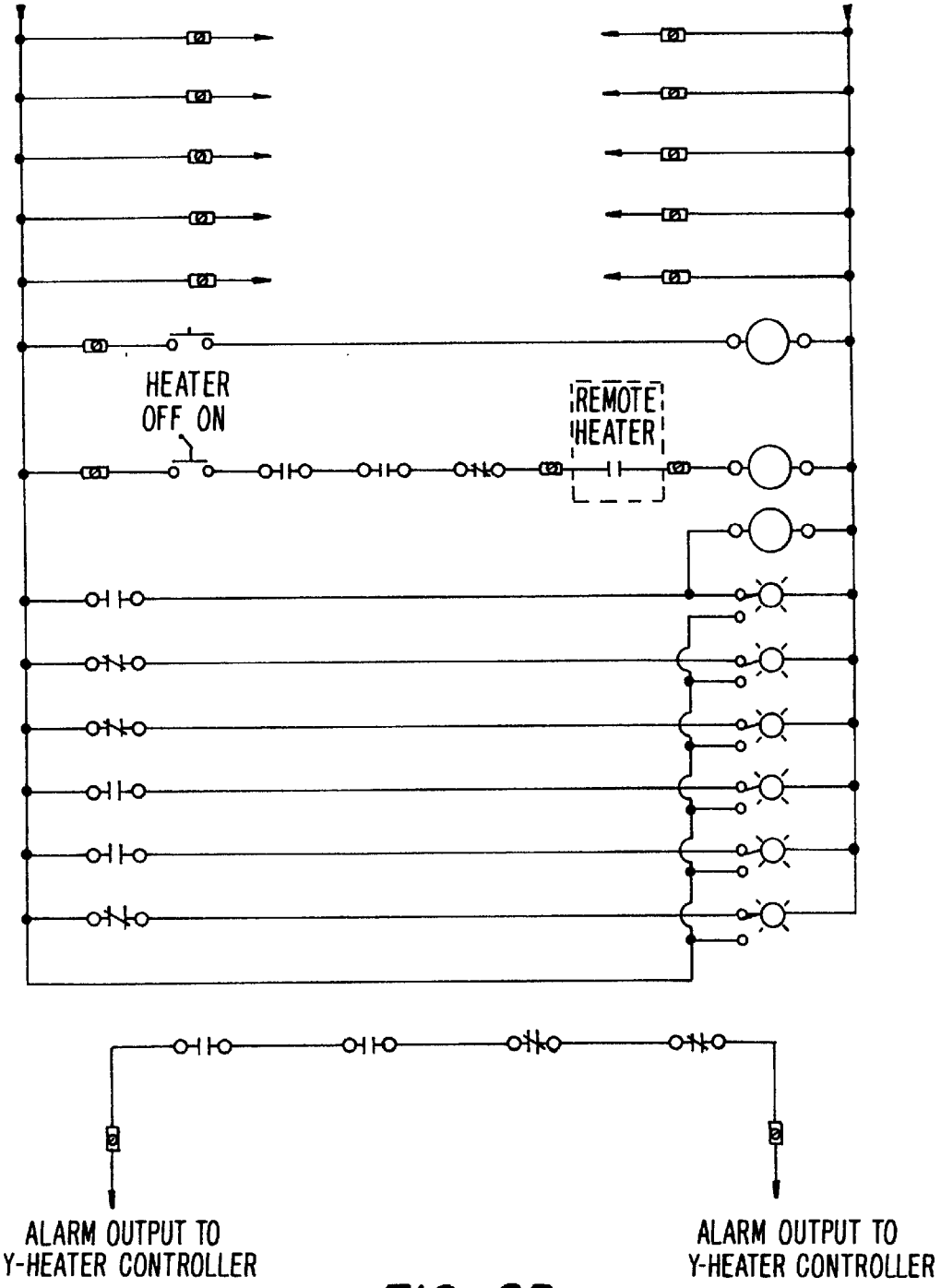
Figure 7A:
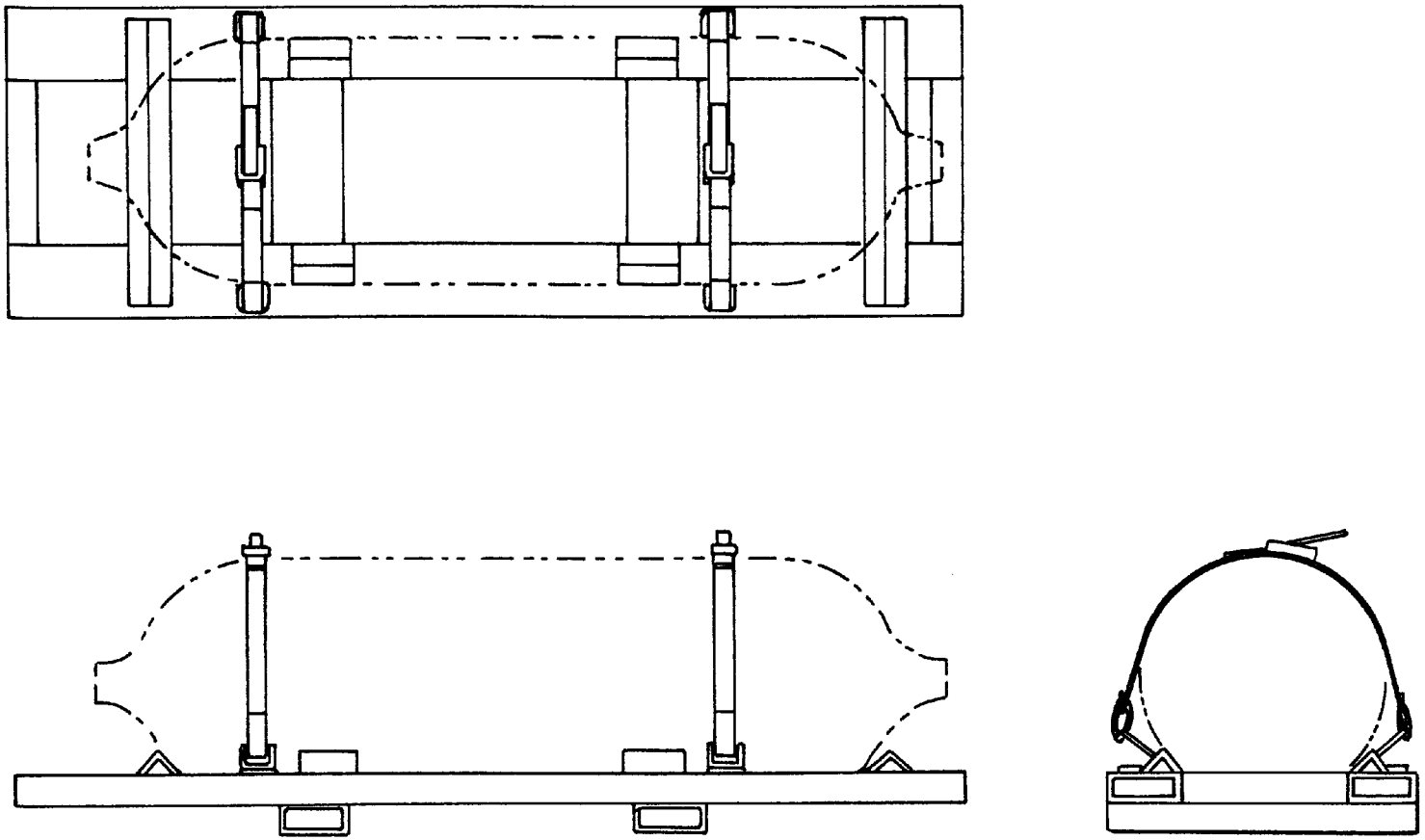
FIG. 7A. PRIOR ART
FIG. 7A is a prior-art diagram of a cylinder plus skid assembly.
Figure 7B:
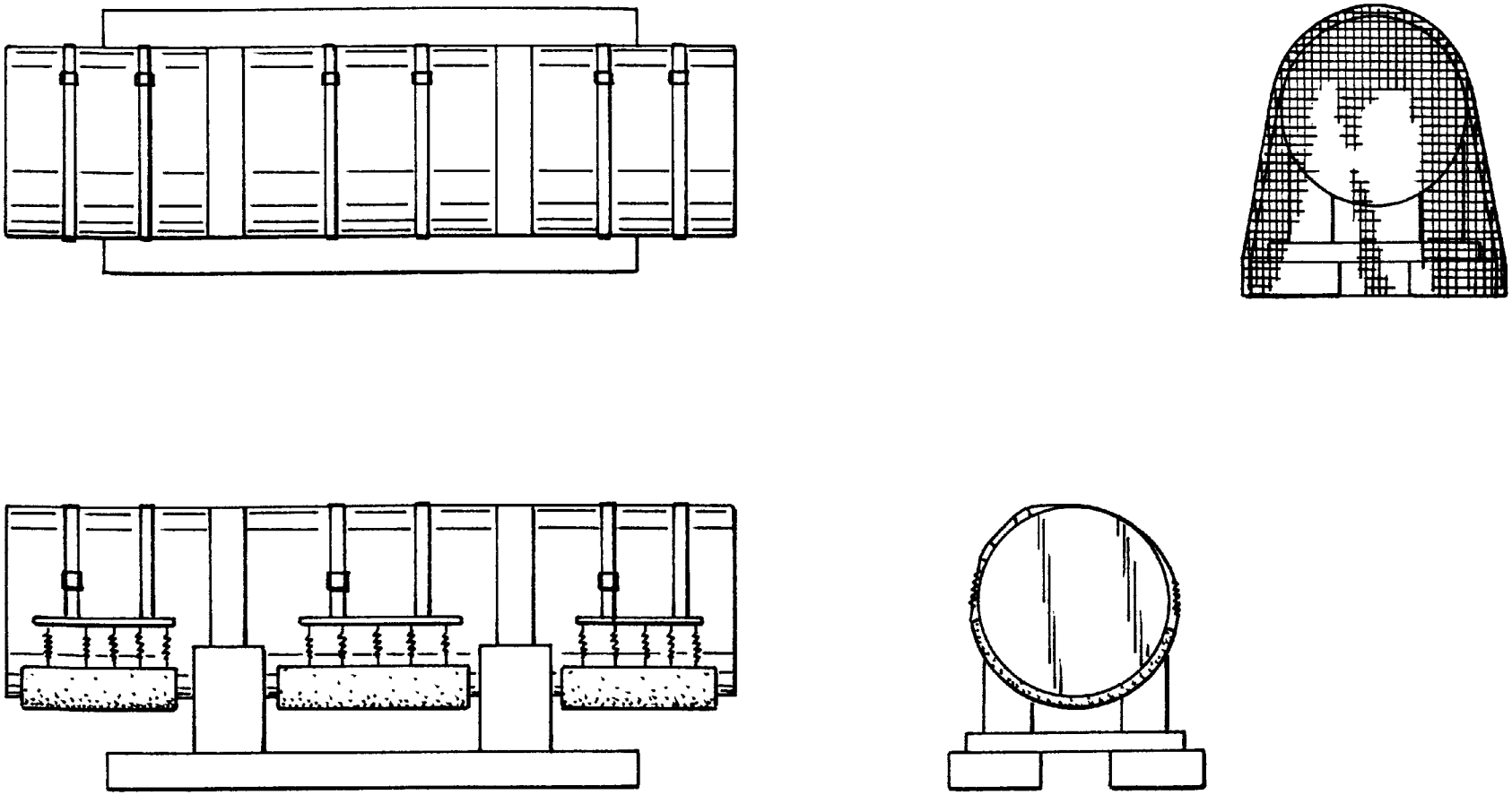
FIG. 7B. PRIOR ART
FIG. 7B is a prior-art diagram of a cylinder plus skid assembly with heaters.

FIGS. 5 and 6 are schematic diagrams showing the actual heater control system used in the preferred embodiment.

In testing preliminary versions of the present invention, it is found that use of a heater skid allows sustained flow rates of ammonia in excess of 450 slpm. This rate is an estimate of how much ammonia can be dispensed based on tests performed using CO2. The actual CO2 flow rate is higher. Flow rates are highly dependent on the chemical properties. Tests showed that the sub-cooling of the cylinder walls was substantially limited.

Figure 8:
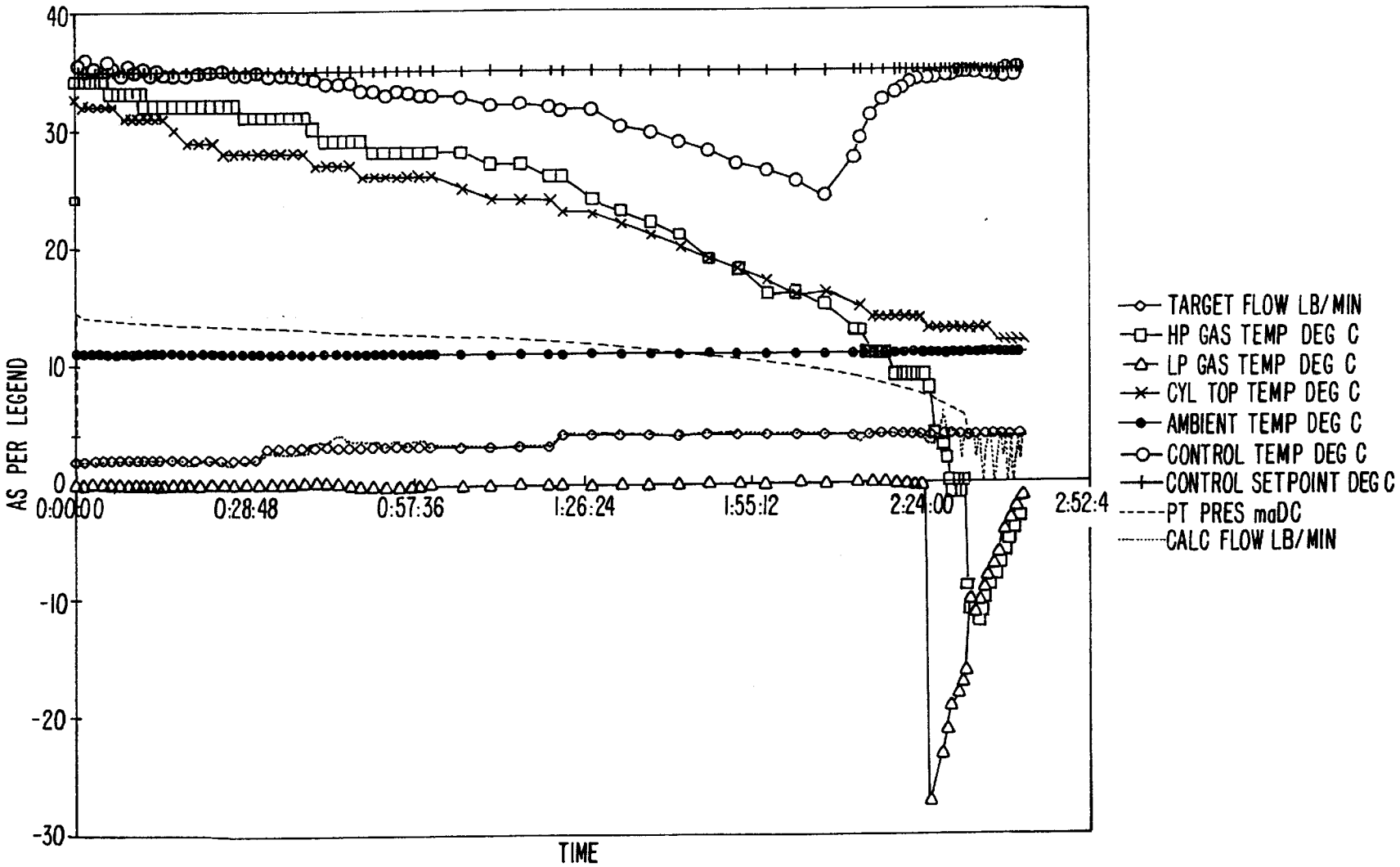
FIG. 8 is a first graph of test results.

FIG. 8 is a graph of test results of the heater skid. A "Y" cylinder of CO2 was used from which flow rate for other chemicals can be computed. In FIG. 8, a target flow rate in excess of what would normally be desired was used. The graph shows the temperature decreasing and then rising as the heaters are activated. The gas temperature increases as a result of the heating and the flow rate is much improved.

Figure 9:
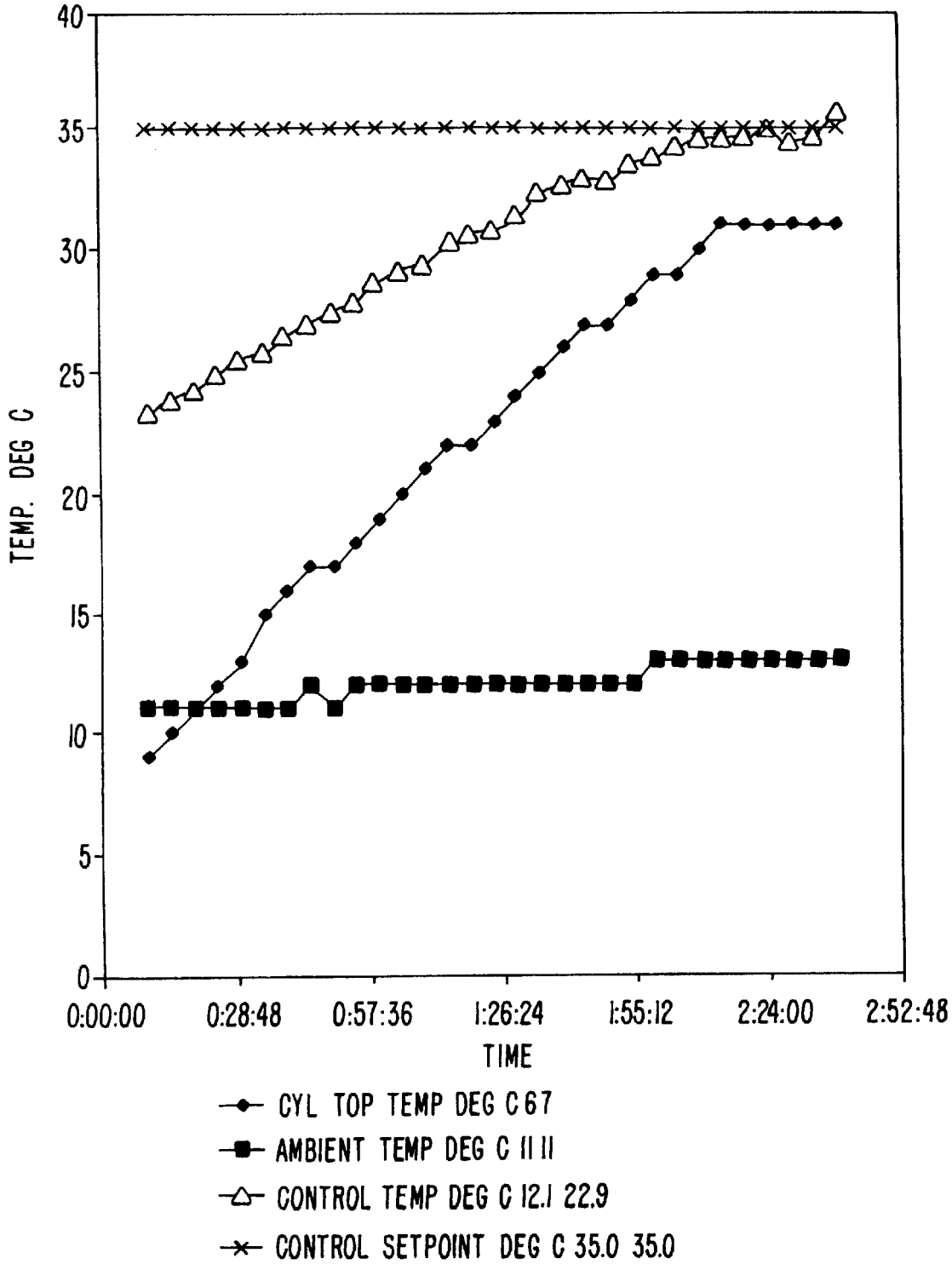
FIG. 9 is a second graph of test results.

FIG. 9 shows cylinder heat-up as a function of time for the test case.

Figure 10:
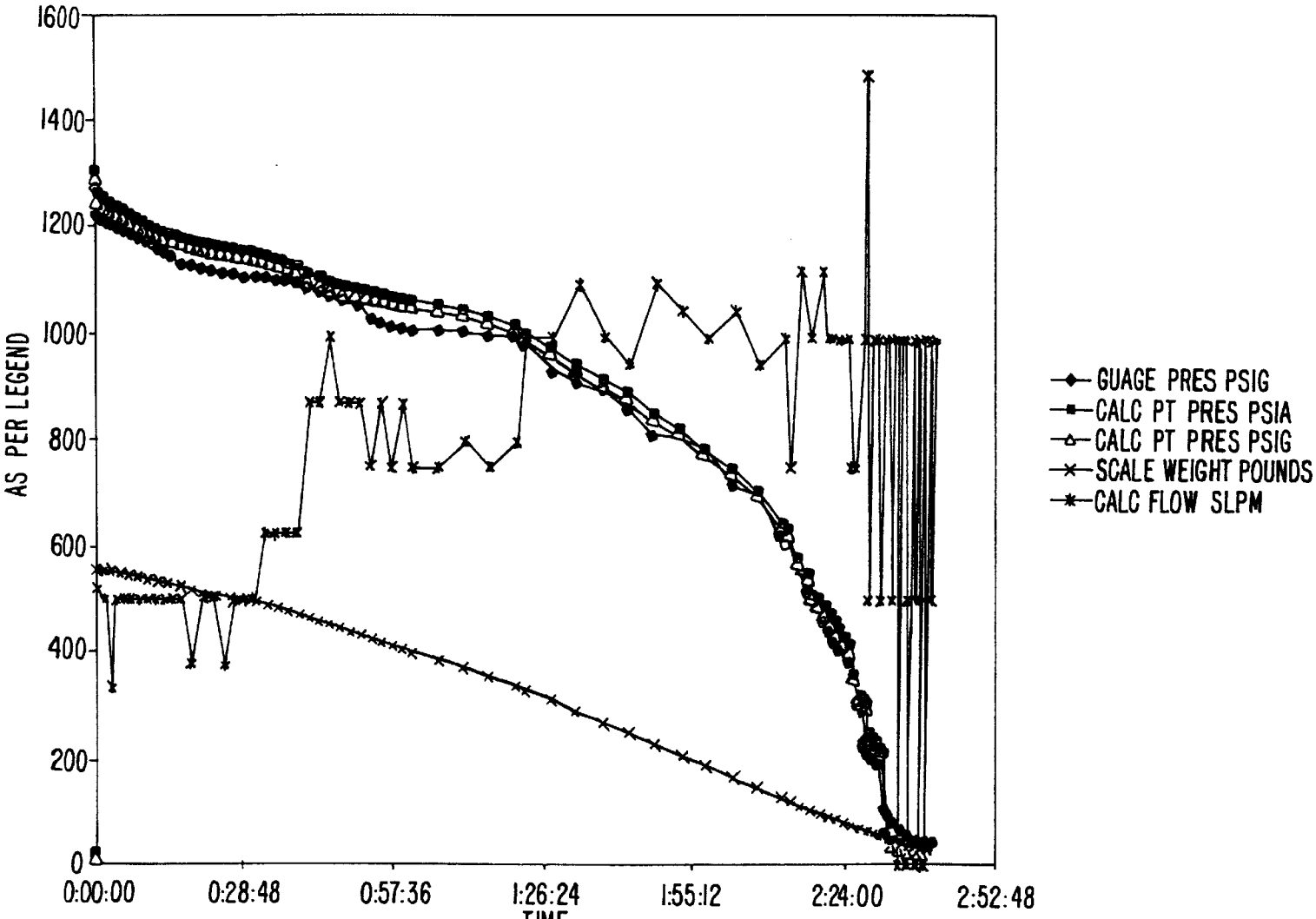
FIG. 10 is a third graph of test results.

FIG. 10 shows a test simulation at flow rates that would normally be expected at a customer site. The starting flow is about 1 pound per minute. After 0.5 hours the flow is increased to 2 pounds per minute. After 0.5 hours the flow was again set to 1 pound per minute. The flow is then increased to 3 pounds per minute for 0.5 hours and then back down to 1 pound per minute.

Although the invention has been described with respect to a specific embodiment, it should be readily apparent that deviations from the specific embodiment are possible and are within the scope of the invention. For example, various shapes and sizes of cylinders may be used by making a compatible change in the shape and size of the skid. Any type of controllable heat source can be employed as a heater. The heaters need not be applied to one side (or bottom) of a cylinder, but can be placed in any manner or orientation as long as a desired heating is achieved. In a variation from the preferred embodiment, the heaters can actually perform the role of supporting the cylinder provided the heaters are strong enough. Many types of heating control systems can be employed that will provide adequate results. Thus, the scope of the invention is to be determined solely by the appended claims.

What is claimed is:

1. A heater skid comprising a framework for receiving a container, wherein the container stores and dispenses compressed gas;

one or more heaters coupled to the framework so that the received container is proximate to the heaters, thus allowing the heaters to heat the container; and a flexible coupling of the heaters to the framework such that the heaters are in tensioned contact with the received container.

2. The heater skid of claim 1, wherein the container is cylindrical and a portion of the gas in the cylinder is liquefied, wherein the cylinder is supported in a horizontal position so that gravity causes the liquefied gas to rest at a bottom side of the cylinder, the heater skid further comprising means for positioning the heaters to heat a portion of the bottom side of the cylinder on which the liquefied gas is resting.

3. The heater skid of claim 1, further comprising one or more support ribs coupled to the framework so that the received container rests on the support ribs while the received container is proximate to the heaters.

4. The heater skid of claim 1, wherein the flexible coupling includes one or more springs.

5. The heater skid of claim 1, further comprising one or more support ribs coupled to the framework so that the heaters are in tensioned contact with the received container while the received container rests on the support ribs.

6. The heater skid of claim 5, wherein the container is an elongated cylinder and has a longitudinal axis along its length, wherein the cylinder has a top and bottom, the heater skid further comprising first and second heaters, wherein the heaters are rectangular sheets of flexible material positioned side-by-side and parallel to the longitudinal axis, wherein the heaters wrap around portions of the received cylinder; and six support ribs coupled to the framework, wherein the six support ribs are arranged as pairs of support ribs with each support rib in a pair positioned on an opposing side of the longitudinal axis, wherein a first pair of support ribs is between the first heater and the top of the cylinder, wherein a second pair of support ribs is between the two heaters, and wherein a third pair of support ribs is between the second heater and the bottom of the cylinder.

7. The heater skid of claim 6, wherein the support ribs are panels cut at a 45 degree angle so that the received cylinder contacts each support rib substantially at a single point so as to reduce thermal conductivity.

8. The heater skid of claim 7, further comprising one or more fork-lift access holes in the framework.

9. The heater skid of claim 7, further comprising one or more tie downs for allowing an insulating blanket to be secured to the framework thus covering the received cylinder and insulating the received cylinder.

10. A heater skid comprising a framework for receiving a cylinder, wherein the cylinder stores and dispenses compressed gas and is elongated and has top and bottom ends;

first and second heaters, wherein the heaters are rectangular sheets of flexible material positioned side-by-side and parallel to the longitudinal axis, wherein the heaters wrap around portions of the received cylinder;

a flexible coupling of the heaters to the framework such that the heaters are in tensioned contact with the received cylinder; and six support ribs coupled to the framework, wherein the six support ribs are arranged as pairs of support ribs with each support rib in a pair positioned on an opposing side of the longitudinal axis, wherein a first pair of support ribs is between the first heater and the top end of the cylinder, wherein a second pair of support ribs is between the two heaters, and wherein a third pair of support ribs is between the second heater and the bottom end of the cylinder.

11. The heater skid of claim 2, wherein the area of the bottom side of the cylinder wall contacted by the liquefied gas varies from a maximum area to a minimum area, the heater skid further comprising:

a heated area defined by placement of the heaters that is completely overlapped by the maximum area; and wherein the heated area substantially overlaps the minimum area.

12. The heater skid of claim 11, wherein the cylinder is approximately 24 inches in diameter, wherein the heated area extends approximately 34 inches about the circumference of the cylinder centered about the bottom side.

13. The heater skid of claim 12, wherein two rectangular heaters are used positioned end-to-end longitudinally along the cylinder.

* * * * *